United States Patent [19]

Govan

[11] Patent Number: 4,507,091

[45] Date of Patent: Mar. 26, 1985

[54] PROPELLER PROTECTING DEVICES

[76] Inventor: Donald T. Govan, P.O. Box 3277 Bahia Mar, Ft. Lauderdale, Fla. 33316

[21] Appl. No.: 481,774

[22] Filed: Apr. 4, 1983

[51] Int. Cl.[3] ..... B63H 5/16

[52] U.S. Cl. ..... 440/73; 416/146 R

[58] Field of Search ..... 440/73, 46; 114/222; 30/240, 263, 264; 56/236, 255, 295, 305; 416/146 R

[56] References Cited

U.S. PATENT DOCUMENTS 756,031 3/1904 Lee ..... 440/73

FOREIGN PATENT DOCUMENTS 256544 9/1968 U.S.S.R. ..... 440/73

*Primary Examiner*—Sherman D. Basinger
*Assistant Examiner*—Jesûs D. Sotelo
*Attorney, Agent, or Firm*—Ronald E. Smith

[57] ABSTRACT

A device that shears lines and nets of the type that can befoul propellers, propeller shafts, bearings, running gear and the like of propeller driven sea-going vessels. Lines or nets that can befoul the running gear of propeller-driven sea-going vessels are sheared by the cooperative action of rotatable blade members that are integrally formed with a collar member that is affixed to and rotates conjointly with the propeller shaft, and non-rotatable blade members that are integrally formed with a ring member which is mounted within a U-shaped channel means that is formed in such rotatable collar member. The non-rotating mounting ring may carry a single blade or a pair of diametrically opposed blades, and is maintained in its operative disposition relative to the rotating blades as a result of its slidable mounting in the channel formed in the rotatable collar. The non-rotatable blade member is held stationary (becoming an opposing blade to the rotating blades) by a forwardly extending rigid arm member that is inserted into a rearwardly opening base members which is itself fixedly secured to a keel or strut means. The forwardly protruding arm and the rearwardly opening base member become a wedge assembly due to their cooperative angular formation. The wedging assembly becomes operative when a line, net or other object provides resistance to rotation of the propeller shaft, and the specific configuration of said wedging assembly enables it to drive the rotating and non-rotating blades into their working configuration, and the amount of force provided by said wedging means is directly proportional to the amount of resistance encountered. Both the rotating and non-rotating blade members are provided with ear or ramp members at their respective distal ends, said ramp members engaging one another just prior to engagement of the main blade bodies, thereby deflecting such main blade bodies a sufficient amount to avoid jamming of such blades, while allowing such blades to nevertheless maintain their operative working disposition relative to one another. Moreover, specific mechanisms to properly mount and align the inventive assembly are disclosed.

9 Claims, 12 Drawing Figures

PROPELLER PROTECTING DEVICES

BACKGROUND OF THE INVENTION

1. Field of the Invention

This invention relates, generally, to devices that cut lines and nets of the type that befoul the propellers and associated parts of sea-going vessels, and more specifically relates to a device that is specifically designed to defeat separation of shearing blades by thick or tough lines and nets and that is provided with means to prevent jamming of rotating and non-rotating blades.

2. Description of the Prior Art

For a detailed description of the prior art in the general field of this invention, reference should be made to the co-pending U.S. national applications of the inventor herein, bearing Ser. No. 06/359,111, filing date 03/17/82, entitled Propeller Protecting Device, and bearing Ser. No. 06/395,859, filing date 07/06/82, entitled Propeller Protecting Devices.

The above-identified disclosures by the inventor herein show constructions that overcome many of the limitations of earlier devices in the field of this invention. However, troublesome jamming can occur from time to time, under certain conditions such as excessive wear, when the rotating and non-rotating blades enter into their cooperative shearing positions. It has also been found that an improved means is needed for securing the line or net cutting assembly to tapered propeller shafts. Moreover, it has been found that a means should be provided to bring diametrically opposed cutting blade members into coplanar relation with one another and to align such blades in a plane perpendicular to the axis of rotation of the propeller shaft.

SUMMARY OF THE INVENTION

The present invention overcomes all of the limitations of earlier devices in the field of this invention. The jamming problem has been solved by providing rotatably mounted fan-shaped (or other suitably shaped) cutting blade members having integrally formed projections or ear members which serve to ramp the blades past each other, at the distal ends thereof that lie coplanar to the cutting edges of the cutting blades. Such ramps on the non-rotatable blades engage similar ramps formed on the rotating blades just prior to the shearing engagement of such rotating and non-rotating blades. Thus, such ramp members serve as "last minute" non-jamming means.

Problems concerning the attachment of the rotating and non-rotating blades to tapered propeller shafts have been overcome by providing a bifurcated collar means that is fixedly secured to and hence conjointly rotatable with the propeller shaft. The collar is relatively elongate in its axial (i.e., length) dimension, and is provided with a centrally disposed, annular channel means that provides a housing for the non-rotatable mounting ring that carries either a single blade or a pair of diametrically opposed blades. Thus, the rotatable collar means has a substantial axial dimension on both sides of the centrally disposed channel means. A plurality of preferably four arcuate adjustment plate or taper pad members are disposed in complementary formed recesses interiorly of such rotatable collar means and such adjustment plates are flush mounted with respect to the inner cylindrical side wall of such collar means prior to adjustment thereof. A plurality of set screws are advanced to bring such adjustment plates into firmly seated relation to the propeller shaft. It has been found that at least one half to three quarters ($\frac{1}{2}$–$\frac{3}{4}$) of the surface area of the inner surface of the rotatable collar should be in contact with the propeller shaft to optimally secure the inventive assembly to such propeller shaft and such taper pads provide additional surface area to accomplish such purpose.

Of course, in applications where the propeller shaft is of uniform diameter, there is no need to employ the taper pad members.

It is therefore seen to be an important object of this invention to provide rotating blades and non-rotating blades that have been specifically configured so that they do not jam when they enter into shearing relation with one another.

Another object is to provide an improved collar means that is more easily securable to a tapered propeller shaft.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the various views of the drawings.

DETAILED DESCRIPTION OF THE PREFERRED EMBODIMENT

Figure 1:
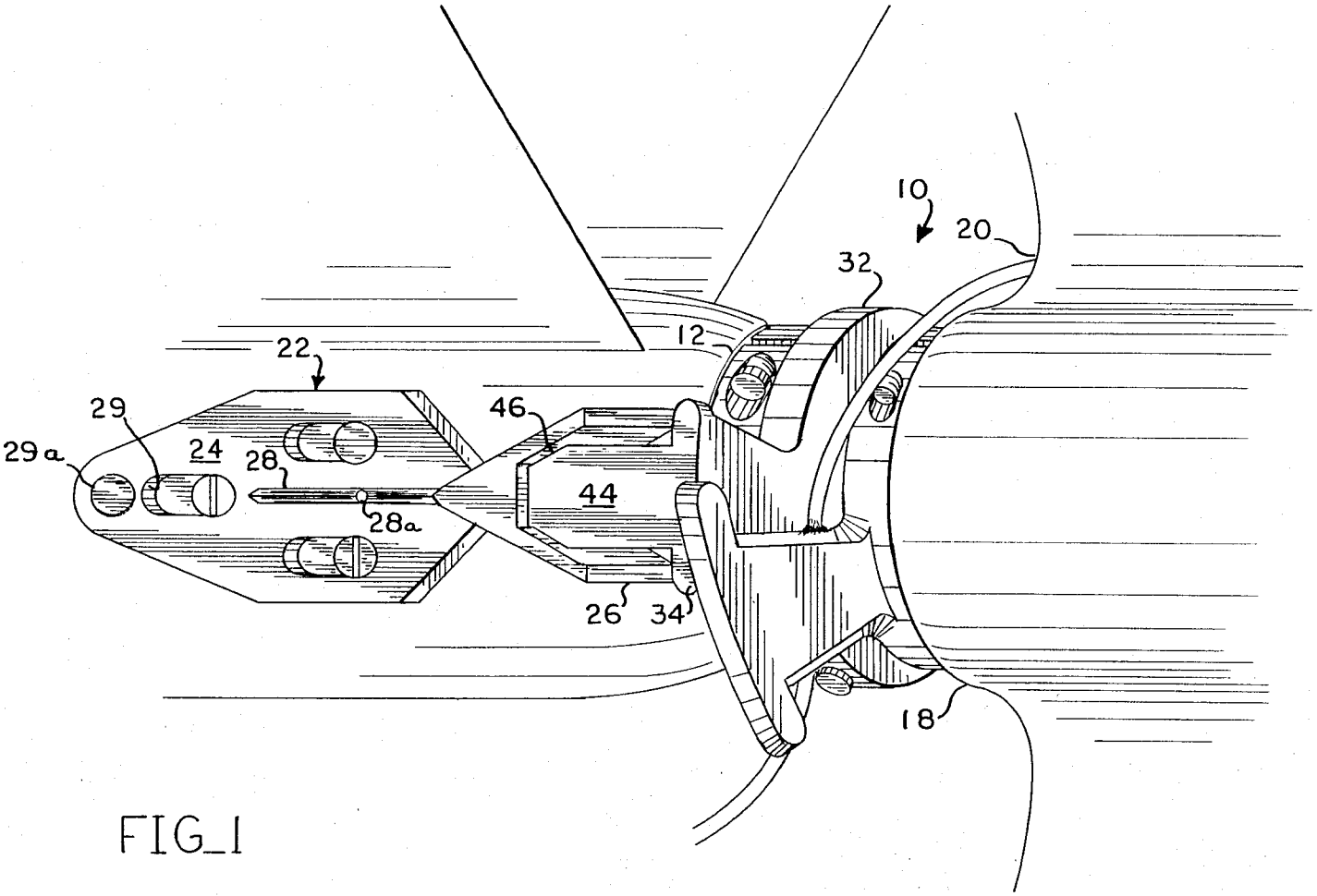
FIG. 1 is a perspective view of the preferred embodiment of the invention.
Figure 2:
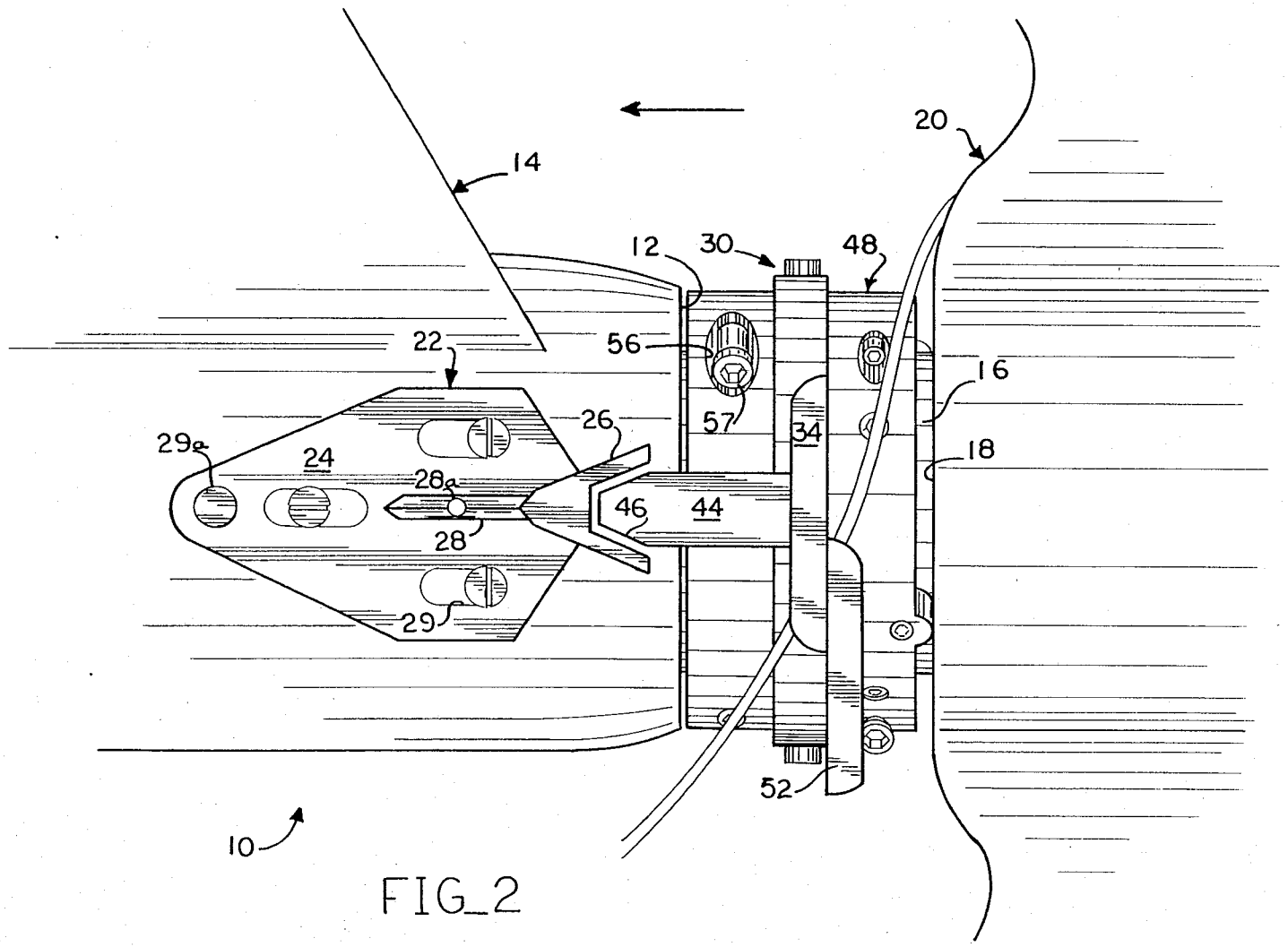
FIG. 2 is a side elevational view of the embodiment shown in FIG. 1.
Figure 5:
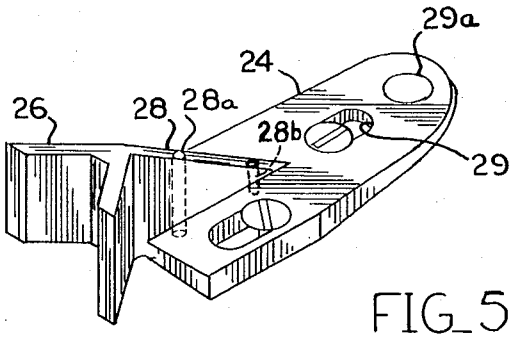
FIG. 5 is a perspective view of the base member shown in FIG. 4.

Referring now to FIGS. 1 and 2, it will there be seen that the preferred embodiment of the invention is generally indicated by the reference numeral 10 as a whole. The assembly 10 is disposed in a reel area defined by the rearward facing, vertically disposed surface 12 of a shaft-stabilizing strut means 14, the propeller shaft 16 and the forward facing, vertically disposed surface 18 of a hub means 20.

As best seen in FIG. 2, the assembly 10 is spaced (3/16", preferably) from said rearward facing surface 12 to allow water flowing through bearings within the strut means 14 to exit therefrom, and to allow for shaft end play movement.

A pair of base members 22, 22, only one of which is shown in FIGS. 1 and 2, are fixedly secured in diametrically opposed relation to one another on opposite sides of the strut means 14. (Although a pair of such members will be referred to hereinafter, it should be understood that only one (1) of such base members is employed in an embodiment of the invention, hereinafter disclosed, wherein only one (1) non-rotating cutting blade is provided.) Each base member 22, 22 includes a base plate portion 24, a rearwardly opening wedge portion 26, and an inclined support wall or web 28. The base plate 24 is independently formed with respect to the integrally formed wedge 26 and web 28. The respective base plate portions 24 are perforated as shown at 29 to allow longitudinal adjustment of such base members 22, 22 relative to the sidewalls of the strut means 14. (Of course, in vessels having no strut means, the base members 22 are affixed to opposite sides of the keel.) Another perforation having a pin received therein is indicated as **29*a*, said pin serving to prevent axial travel of the base members 22. A bore is formed in the web 28 to receive a hinge pin 28*a* therein, as is clearly shown. A shear pin 28*b* is also provided at the lower portion of the web 28 as shown. Thus, if the blades encounter an unshearable object such as a thick metallic cable, pin 28*b* will shear, thereby allowing the wedge/web 26/28 assembly to rotate freely about hinge pin 28*a*. As will become apparent as this description proceeds, this highly desirable movement of the member 26/28** under such conditions represents a controlled failure of the inventive mechanism. In the absence of such a controlled failure, the non-rotatable cutting blade, hereinafter described, could break off, or, worse, the craft equipped with the inventive assembly could suffer transmission difficulties.

Figure 6:
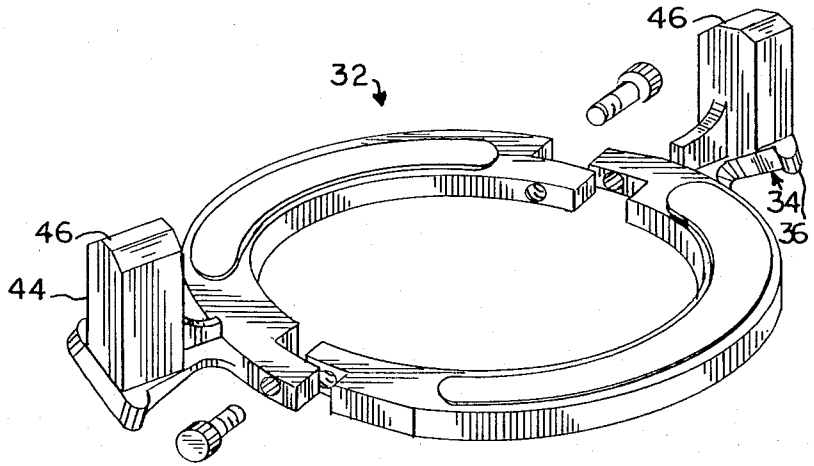
FIG. 6 is a perspective view of the non-rotatable blade assembly.
Figure 7A:
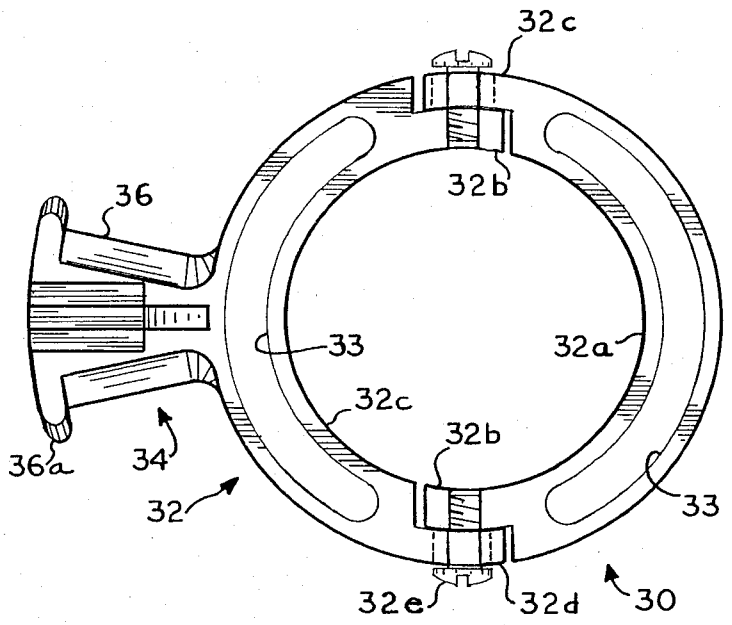
FIG. 7A is a top plan view of one embodiment of the non-rotatable blade assembly, showing only one blade integrally formed therewith.
Figure 7B:
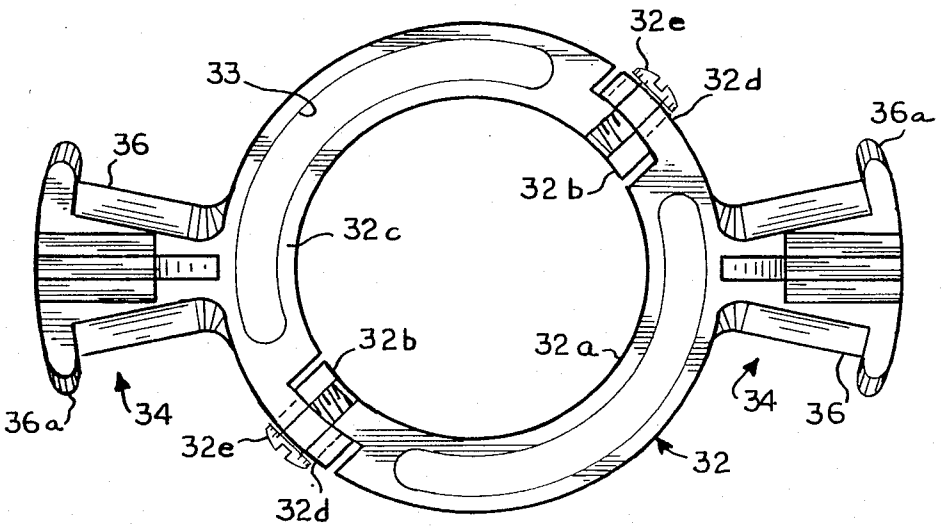
FIG. 7B is a top plan view of a second embodiment of the non-rotatable blade assembly showing two diametrically opposed cutting blades integrally formed therewith.
Figure 10:
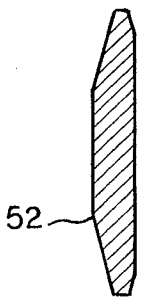
FIG. 10 is a sectional view of the cutting blade members shown in FIGS. 8 and 9.

The stationary, or non-rotatable shearing means is indicated generally by the reference numeral 30, is best seen in FIGS. 6, 7A, and 7B, and includes a bifurcated ring member 32 having a generally rectangular cross section. Fan shaped, or dove tailed, (or other suitably shaped) cutting blade members 34, 34 extend radially from the ring member 32, and include cutting edges 36, 36. A single blade, shown in FIG. 7A, may also be employed. The blades 34, 34 lie in a plane orthogonal to the axis of rotation of the propeller shaft 16. The bifurcated structure of the ring 32 permits its halfs to be attached to one another. As shown in FIGS. 7A and 7B, each half portion of the ring 32 is provided with an arcuate channel means 33 of nominal depth. A complementally formed elastomeric member 35 is disposed within each of said channels 33, as shown in FIG. 6, and has a thickness slightly greater than the depth of the channels or depressions 33. Accordingly, such elastomeric members 35 reduce the sliding friction between the rotating collar 48, hereinafter disclosed, and the non-rotating ring member 30. The members 35 are preferably formed of E34 Millethane, and are cooled and lubricated by water flow.

As shown in FIGS. 7A and 7B, the point of bifurcation of the ring member 32 may vary, depending upon the number of stationary cutting blades 34. For example, in the embodiment shown in FIG. 7A employing one cutting blade 34, the ring 32 is bifucated 90 degrees from the axis of symmetry of such solitary blade 34. However, in the embodiment shown in FIG. 7B, the bifurcation occurs 30 degrees from the axis of symmetry of the non-rotatable blades 34, 34.

The differing angular disposition of the point of bifurcation for the single blade embodiment or the double blade embodiment is an important feature of this invention. The specific positioning of the point of bifurcation is a function of the external forces imparted against the non-rotating ring 30. More specifically, tests of the inventive apparatus have shown that the greatest stress is imparted to the ring 30 at diametrically opposed points that are about 30 degrees from the blades 34, 34. Accordingly, the hinge assembly as shown in FIG. 7B is provided at such high stress points. It is also important to note that the bored portions formed in offset portions **32*d*, 32*d* (FIG. 7B) are of greater diameter than the similar bored portions formed in the one-blade embodiment of FIG. 7A. This allows half portions 32*a*, 32*a*** (FIG. 7B) to displace in a plane perpendicular to the axis of rotation of the propeller shaft, as is desired.

A close inspection of FIGS. 7A and 7B is also in order so that the novel means of joining the separate half portions of the ring 30 may be seen.

More specifically, half portion **32*a* has an offset portion 32*b* that is internally threaded as shown, i.e., the innermost 1/16" thereof is not tapped. A cutaway portion is formed adjacent portion 32*b* as shown to accommodate offset portion 32*d* of half portion 32*c*. Portion 32*d* is bored as shown, so that screw 32*e* does not threadingly engage portion 32*d*. Importantly, the untapped portion of 32*b* prevents screw member 32*e* from overly compressing the respective offset portions 32*b*, 32*d* against one another. Accordingly, the arrangement shown provides a hinged connection between the half portions 32*a*, 32*a*. Thus, such half portions 32*a*, 32*c* are free to pivot about the longitudinal axis of symmetry of the screw member 32*e***.

A forward projecting arm 44, best seen in FIGS. 1, 2, and 6, is integrally formed with each cutting blade member 34, 34. Each arm 44, 44 is disposed parallel to the axis of rotation of the propeller shaft 16 and projects at right angles to and extends forwardly from its associated blade and terminates in a wedge-shaped portion 46. The respective wedge-shaped portions 46, 46 mate with the associated wedge-shaped openings 26, 26 of the base members 22, 22, as shown best in FIGS. 1 and 2. The portions 46 and 26 are specifically dimensioned and configured so that when increasing amounts of external force are imparted to cause convergence of such portions, the amount of resistance to such convergence will increase by a corresponding amount, and a proportional force will be imparted to stationary cutting blade along the axis of propeller rotation, in a rearwardly direction. The invention is not limited to the specific wedge-shaped configuration shown and described herein, it being understood that the desired wedging action can be achieved by a plurality of designs that will be apparent to those skilled in the art of design, in view of the teachings of this disclosure.

Attention should now be directed to FIGS. 1, 2, 3, 8, and 9, wherein the rotatably mounted shearing means, designated 48 as a whole, is shown. The shearing means 48 includes a collar of bifurcated construction, having halve portions 50, 50 to facilitate its attachment to a propeller shaft 16 without requiring removal of the propeller. A pair of fan-shaped cutting blade members 52, 52 having cutting edges 54, 54 extend radially from the half portions 50, 50, in diametrically opposed relation to one another. Projections or ear members 54*a* are integrally formed on the distal free end of each blade 52, on both the trailing and leading edges thereof as depicted (since collar 48 can rotate in either of two directions). These ear members 54*a*, or ramping members, cooperate with the ramping members 36*a* formed on the non-rotating blades 34 to prevent troublesome jamming that may occur in the absence of such ears. More specifically, the respective ramping members engage one another before the main bodies of the respective blade members engage. In the absence of such ramping means, it has been found that excessively worn blades can jam. Countersunk bores 56, 56 are formed in the respective half portions 50, 50 as shown to receive associated screw means 57 (FIGS. 1, 2) to unite the halves 50, 50 to form a collar means about the propeller shaft 16.

Figure 3:
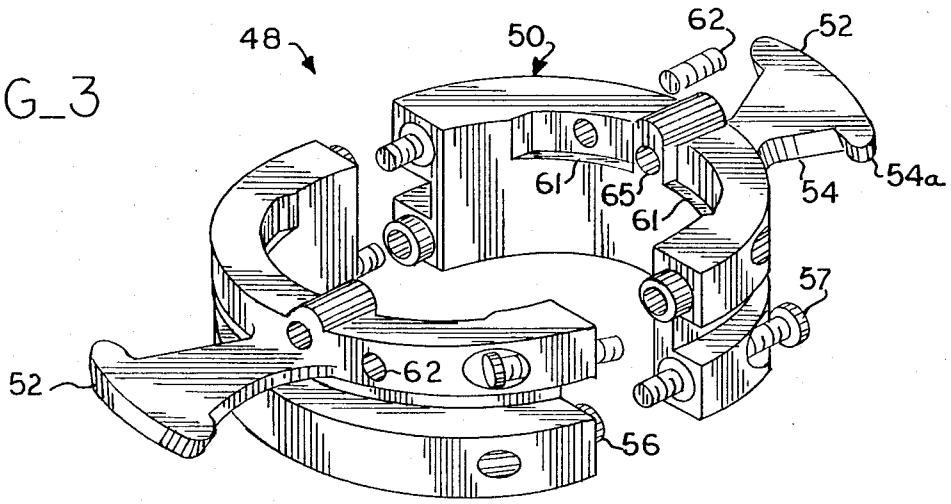
FIG. 3 is a perspective view of the preferred rotatable cutting blade assembly.
Figure 4:
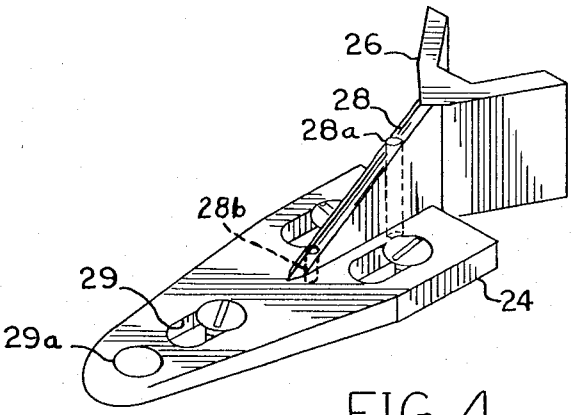
FIG. 4 is a perspective view of the base means that performs the function of maintaining the non-rotatable cutting blades in stationary position, and which provides a wedge to bring the blades into cutting position.
Figure 9:
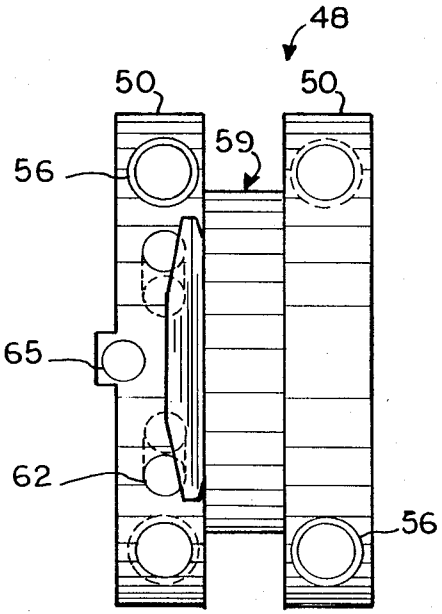
FIG. 9 is a side elevational view of the embodiment shown in FIG. 8.
Figure 11:
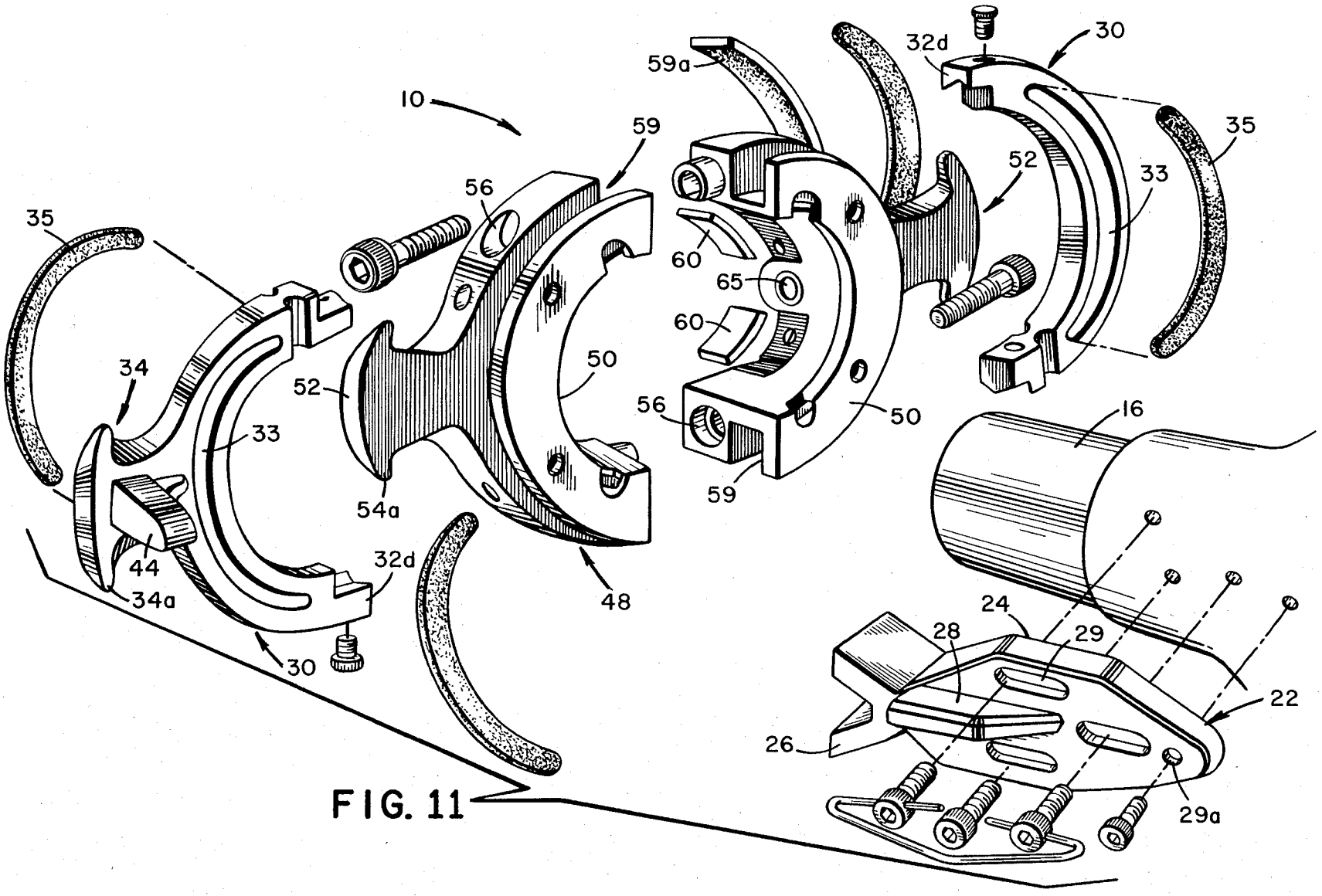
FIG. 11 is an exploded perspective view showing all of the inventive parts.

As best shown in FIGS. 3 and 9, an annular channel is formed in each half portion 50, 50 so that a continuous U-shaped annular channel 59 is provided when the half portions 50, 50 are united to provide a collar means as aforesaid. The non-rotatable ring member 32, 32 which carry stationary cutting blade members 34, 34 is slidably received within the annular channel 56, as is clear from FIGS. 1 and 2. Clearly, the slidable mounting of the stationary shearing means 30 within the annular channel 59, of the rotating shearing means 48 brings the non-rotatable cutting blade members 34, 34 and the rotating cutting blade members 52, 52 into line and net cutting relation to one another attendant each rotation of the propeller shaft 16. A friction-reducing member 59*a* (FIG. 11) of annular configuration is disposed about the bottom of channel 59 to reduce the friction between the rotatable and non-rotatable collar and ring members. The member 59*a* is preferably formed of a bearing material known as Rulon J.

When the vessel upon which the inventive assembly 10 is mounted undergoes acceleration, its propeller shaft 16 will axially and radially displace in a rearwardly or forwardly direction (depending upon whether the craft is going forwardly or rearwardly). The provision of annular channel 59 in the rotatable collar means 48 will cause the non-rotatable collar ring member 30 and the rotatable collar 48 to move as a unit during such displacement, thereby avoiding any separation of the rotating and non-rotating blades. When a thick or tough line or net is being sheared, the interlocking of such moving and stationary blades that is provided by the annular channel 59 also serves to prevent separation of the cooperatively positioned cutting blades. Moreover, the interlocking nature of the inventive parts also serves to accommodate wobbling motion of the shaft 16, such wobbling motion generally referred to in the boating industry as "bearing play".

The inventive blades are preferably formed of a stainless steel selected from the 400 series of stainless steel, and are passivated and nickel plated. The base members 22, 22 and the taper pads 60 (hereinafter disclosed) are preferably formed of 17-4 stainless steel. Empirical studies may indicate the use of other, perhaps even more desirable materials, however. The metals now in use as disclosed herein have been selected due to their castability, hardness and corrosion resistance.

Many propeller shafts are tapered, and means must therefore be provided to allow the rotating collar means 48 to seat against such shafts.

Figure 8:
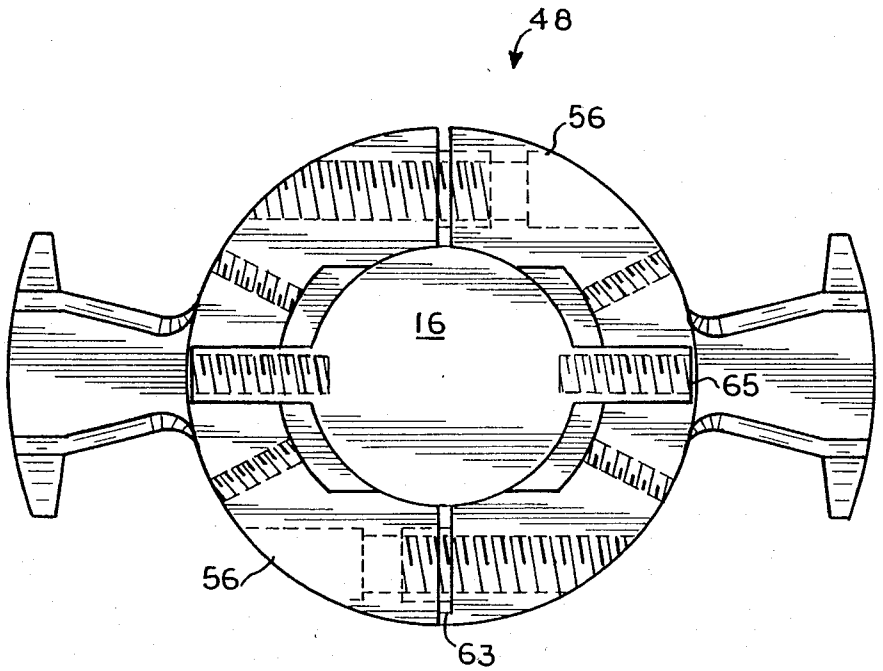
FIG. 8 is a top plan view of the collar assembly shown in FIG. 3.

The inventive assembly includes three (3) features that cooperate to provide the needed mounting feature. Referring to FIG. 8, it will be observed that an offset portion, or lip 63 is integrally formed with half portion 50*b* of the rotatable collar member 48. The lip 63 prevents half portions 50*a*, 50*b* from contacting one another, as is clearly shown, and such lip 63 is specifically formed so that when it seats firmly against half portion 58, as shown, the diametrically opposed blade members 52, 52 will be perfectly aligned with one another in a common plane. Thus, when a collar 48 is being installed to a propeller shaft, lip 63 is carefully seated along its length (which length is equal to the thickness of collar 48) to bring the half portions and hence blades 52, 52 into coplanar relation to one another.

However, it should be understood that such coplanar blades could very well lie in a plane that is oblique to a plane perpendicular to the axis of rotation of the shaft, if such shaft is of non-uniform diameter. Thus, a means must be provided to align the coplanar blades in a plane that is perpendicular to such axis. The preferred means includes a pair of diametrically opposed, externally threaded alignment screw members (not shown) that are threaded into the internally threaded bore means 65, 65 shown in FIG. 3. The distal end of each alignment screw member is received within a complementary formed shallow bore 16*a* formed in diametrically opposed portions of the propeller shaft. This arrangement, in effect, keys the alignment screws to the shaft and prevents the cutter assembly from sliding down the tapered shaft. It is critical to note that advancing such as alignment screw will effect a displacement of its associated blade 52. Thus, after lip 63 has been properly seated, as aforesaid, a careful manipulation of the opposing alignment screws will orient blades 52, 52 in a plane perpendicular to the axis of propeller shaft rotation, as is desired.

As mentioned earlier, however, at least one half to three quarters ($\frac{1}{2}$ to $\frac{3}{4}$) of the surface area of the interior surface of the rotatable collar 48 should make contact with the propeller shaft to ensure proper holding operation of the novel assembly 10.

The preferred means to assure that the required surface area contact will be made between the rotatable collar 48 and the propeller shaft may take the form of a plurality of preferably four (4) (or two (2)) adjustment plates, or taper pads, collectively designated 60 in FIG. 8. The pads 60 are flush mounted within respective ones of the complementary formed recesses collectively designated 61 in FIG. 3. A plurality of preferably four (4) equidistantly and circumferentially spaced, radially aligned threaded bore means, collectively designated 62, are formed in the collar 48, as shown (each bore 62 being radially disposed to the axis of rotation of the shaft 16). Set screws extending through such bores 62 are selectively adjusted to seat each plate 60 against the tapered shaft after the aforementioned alignment screws have been properly aligned.

The novel assembly provides an improved line and net cutter means that performs in a highly functional manner. The United States Coast Guard is in need of the novel assembly, as are numerous other institutions and individuals, both commercial and navy.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. An apparatus designed to cut lines or nets of the type that may befoul the running gear of propeller driven, sea-going vessels, comprising, a first cutting blade means including a single cutting blade member mounted in non-rotatable relation to a rotatable propeller shaft means, a second cutting blade means including a pair of diametrically opposed, rotatably mounted blade members disposed in line or net shearing relation to said first cutting blade means, attendant rotation thereof, said non-rotatable blade member and said rotatable blade members provided with ramp-like portions on the respective distal ends thereof, said ramp-like portions projecting outwardly in the plane of rotation of said rotatable blades, from a main body portion of each of said respective blade members so that the respective main body portions of such blades will cooperate with one another to achieve a shearing action in the absence of jamming, even when such blades are worn.

2. The apparatus of claim 1, wherein said second cutting blade means are carried by a rotatable collar means that has a U-shaped channel formed therein orthogonal to its axis of rotation, said channel disposed centrally thereof, wherein said first cutting blade means is carried by a non-rotatable ring means that is slidably mounted within said channel, and wherein friction reducing means are mounted on said non-rotatable ring means so that said rotatable collar means rotates freely and substantially independent of said non-rotatable ring means.

3. The apparatus of claim 2, wherein said rotatable collar means is of bifurcated construction, having two (2) half portions, of semi-circular configuration, and wherein an offset or lip means at the radially outermost portion of one of said half portions is specifically formed to align the abutting halfs thereof, thereby bringing the cutting blades of the rotatable collar means into coplanar relation to one another.

4. The apparatus of claim 3, wherein said rotatable collar means is provided with a pair of diametrically opposed, axially aligned bore means formed therein for the screw-threaded reception therein of a pair of adjustment screw members, said bores and associated screw members being disposed in a line parallel to, but offset from, the longitudinal axis of symmetry of said second cutting blade means, wherein the distal free end of said adjustment screw members are respectively disposed in complementary formed, diametrically opposed, bores formed in a propeller shaft upon which said collar means is mounted, said bores and distal ends providing a keying function between said adjustment screws and said shaft to prevent slippage of said assembly relative to said shaft, and said offset between said adjustment screw and said blade axis providing a leverage means whereby selective advancement of said adjustment screws imparts movement to said collar means so that the blade members made co-planar by said lip means are collectively aligned orthogonal to the axis of rotation of said shaft attendant such selective advancement of said adjustment screws.

5. The apparatus of claim 4, wherein recess members are formed on the inner, cylindrical side walls of said rotatable collar means, on one side only of said U-shaped channel formed centrally thereof, and wherein complementary formed, flush mounted adjustment plates or taper pad means are disposed in associated ones of said recesses, and wherein set screw means individual to each of said taper pad means are disposed in circumferentially spaced relation about said rotatable collar means, in radial relation to the axis of rotation of said propeller shaft, so that selective advancement of said set screw means accomplishes seating of said adjustment plates against said propeller shaft and hence of said rotatable collar means to said shaft even if said shaft is of tapered or non-uniform diameter.

6. The apparatus of claim 5, wherein said non-rotatable ring means is of bifurcated construction, wherein the respective half portions thereof are hingedly interconnected for pivotal movement therebetween about an axis radial to the axis of rotation of said propeller shaft, and wherein aligned, diametrically opposed hinge means are formed at ninety degree angles from said single cutting blade member.

7. The apparatus of claim 5, wherein said first cutting blade means further comprises first and second cutting blade members, said first and second cutting blade members being mounted in diametrically opposed relation to one another on said non-rotatable ring means, and wherein the half portions of said ring means are hingedly interconnected to one another at a point angularly disposed approximately thirty degrees from said blade members.

8. The apparatus of claim 7, wherein the respective distal free ends of the half portions of said non-rotatable ring means are provided with cut out portions that are radially adjacent to non-cut out portions thereof, so that said halves interlock attendant cooperative positioning of juxtaposed cut out portions and non-cut out portions.

9. The apparatus of claim 8, wherein the radially outermost of said non-cut out portions of said distal free ends of said half portions are provided with a radially aligned bore means, and wherein the radially innermost of said non-cut out portions are internally threaded to a point at least slightly radially outward of the inner periphery of said ring means, and wherein a different screw member is disposed through different ones of said bores and screw threadedly engaged with different ones of said radially innermost, diametrically opposed non-cut out portions, wherein said screw means is specifically positioned so that the distal free end of each non-cut out portion is circumferentially spaced apart from a radially aligned wall that at least in part defines its associated cut out portion, and wherein said bore diameter is greater than the diameter of said screw member extending therethrough so that said half portions are free to slide relative to one another in opposite rotational directions, said screw members also serving as a hinge pin means to allow pivotal movement between said respective ring half portions.

* * * * *